US009820520B2

(12) United States Patent
Bolen

(10) Patent No.: US 9,820,520 B2
(45) Date of Patent: Nov. 21, 2017

(54) BUTTON ADAPTER FASTENING SYSTEM

(71) Applicant: Robert Edward Bolen, Bethesda, MD (US)

(72) Inventor: Robert Edward Bolen, Bethesda, MD (US)

(73) Assignee: Robert Edward Bolen, Bethesda, MD (US)

( * ) Notice: Subject to any disclaimer, the term of this patent is extended or adjusted under 35 U.S.C. 154(b) by 0 days.

(21) Appl. No.: 15/203,365

(22) Filed: Jul. 6, 2016

(65) Prior Publication Data

US 2016/0309820 A1 Oct. 27, 2016

Related U.S. Application Data

(63) Continuation-in-part of application No. 14/857,132, filed on Sep. 17, 2015, which is a continuation-in-part of application No. 14/523,844, filed on Oct. 25, 2014, now Pat. No. 9,713,354.

(60) Provisional application No. 61/906,364, filed on Nov. 19, 2013.

(51) Int. Cl.

| | |
|---|---|
| ***A41F 1/00*** | (2006.01) |
| ***A44B 1/14*** | (2006.01) |
| ***A44B 17/00*** | (2006.01) |
| ***A44B 1/08*** | (2006.01) |
| ***A44B 1/30*** | (2006.01) |
| ***A44B 1/18*** | (2006.01) |

(52) U.S. Cl.

CPC ..... *A41F 1/002* (2013.01); *A41F 1/00* (2013.01); *A44B 1/08* (2013.01); *A44B 1/185* (2013.01); *A44B 1/30* (2013.01); *A44B 1/14* (2013.01); *A44D 2203/00* (2013.01); *Y10T 24/45257* (2015.01)

(58) Field of Classification Search

CPC ... A41F 1/00; A41F 1/002; A44B 1/30; A44B 17/0064; A44B 1/08; A44B 1/185; A44B 1/14; Y10T 24/45257; Y10T 24/4578; Y10T 24/45089; A44D 2203/00

See application file for complete search history.

(56) References Cited

U.S. PATENT DOCUMENTS

| | | | | |
|---|---|---|---|---|
| 3,141,216 | A * | 7/1964 | Haskell | A41F 1/002 24/303 |
| 8,631,517 | B1 * | 1/2014 | Blakely | A44B 1/28 2/266 |
| 9,220,321 | B1 * | 12/2015 | Sun | A44B 1/04 |
| 9,307,806 | B1 * | 4/2016 | Dorman | A44B 1/14 |
| 2005/0177985 | A1 * | 8/2005 | Sjoquist | A41F 1/002 24/104 |

(Continued)

*Primary Examiner* — Robert J Sandy
*Assistant Examiner* — Louis Mercado
(74) *Attorney, Agent, or Firm* — Duane Morris LLP

(57) ABSTRACT

A fastening system that either attaches to existing buttons or attaches directly to an article of clothing are presented. The fastening system has a first portion that attaches to a button hole or a first part of the article and a second portion that attaches to a button or second part of the article. The first portion and second portion detachably attach to each other by a twist-lock, magnetic mechanism, or some other attachment mechanism. Alternatively, the fastening system can be built directly into an article without augmenting an existing button and button-hole fastener.

10 Claims, 18 Drawing Sheets

(56) References Cited

U.S. PATENT DOCUMENTS

| | | | | |
|---|---|---|---|---|
| 2013/0232729 | A1* | 9/2013 | Abadi | A44B 6/00 24/66.4 |
| 2014/0259553 | A1* | 9/2014 | Sjoquist | A41F 1/002 24/303 |
| 2016/0360810 | A1* | 12/2016 | Lim | A41F 1/002 |

* cited by examiner

BUTTON ADAPTER FASTENING SYSTEM

CROSS-REFERENCE TO RELATED APPLICATIONS

This application is a continuation-in-part of U.S. Non-Provisional application Ser. No. 14/857,132, filed on Sep. 17, 2015 and entitled "Button Adapter Fastening System", which is a continuation-in-part of U.S. Non-Provisional application Ser. No. 14/523,844, filed on Oct. 25, 2014, now U.S. Pat. No. 9,713,354 and entitled "Twist-Lock Button", which claims the benefit of U.S. Provisional Application No. 61/906,364 entitled "Twist-Lock Button" filed Nov. 19, 2013, the entire disclosures of each and all of the above mentioned references are hereby incorporated herein by reference.

FIELD OF THE INVENTION

The present invention generally relates to fastening systems. Specifically, this invention relates to various embodiments of a fastening system that either attaches to existing buttons or attaches directly to an article of clothing. In preferred embodiments of the present invention, the fastening system has a first portion that attaches to a buttonhole or a first part of the article and a second portion that attaches to a button or second part of the article. The first portion and second portion detachably attach to each other by means of a twist-lock, magnetic mechanism, or some other attachment mechanism. Alternatively, the fastening system can be built directly into an article without augmenting an existing button and buttonhole fastener.

BACKGROUND OF THE INVENTION

Fasteners are an important part of sporting. Particularly in extreme applications, such as skiing, snowboarding, sailing, climbing, skydiving, bungee jumping, mountaineering, etc., having reliable fasteners for clothing and equipment can mean the difference between life and death. However, standard fasteners of the industry all have some kind of weakness that makes them less than ideal. Snaps, although great for party shirts, tend to come undone under heavy loads and high winds. Buttons pop off or break after prolonged use or in extreme conditions. Zippers are notorious for jamming at the most inopportune moments. Hook-and-loop fasteners tend to wear out over time.

In addition, standard fasteners are often difficult for people who have difficulty with fine motor skills. In particular, there are many people, including, but not limited to, young children, stroke recoverees, people with neurological disorders (e.g. Cerebral Palsy and Parkinson's), people with ALS, persons with advanced Dementia, people with multiple sclerosis, injured veterans, people with arthritis, and amputees, that find it difficult to manipulate buttons, snaps, zippers, and hook-and-loop fasteners.

Thus there is a need in the industry for a fastener that is durable, secure, and immune to jamming, while still being easy to use for all people of varying abilities. These and other features and advantages of the present invention will be explained and will become obvious to one skilled in the art through the summary of the invention that follows.

SUMMARY OF THE INVENTION

Figure 1:
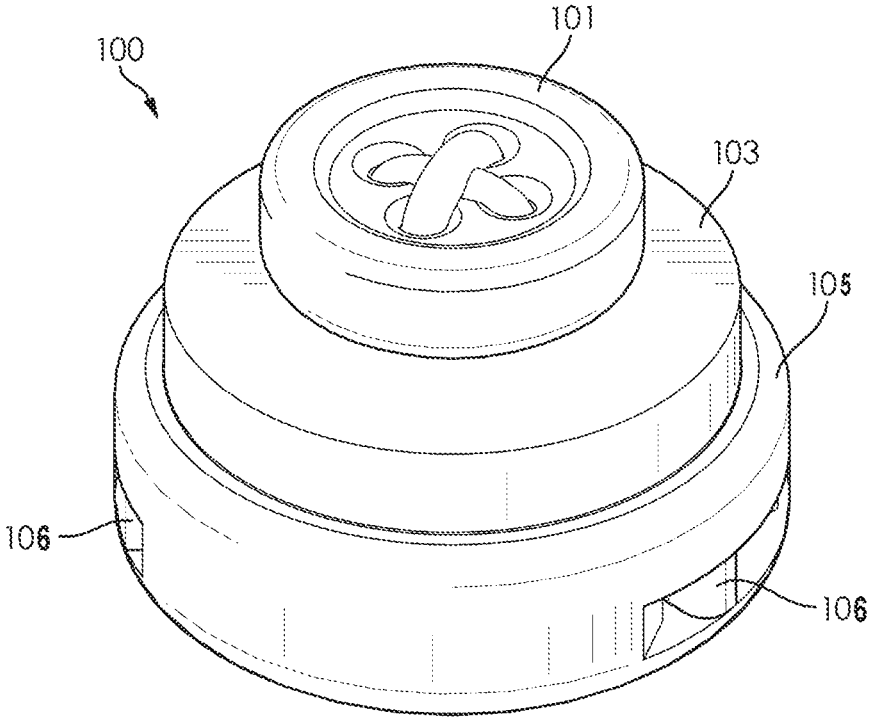
FIG. 1 shows a perspective view of a button adapter with the connector post on the snap button magnetic component, in accordance with an embodiment of the present invention.
Figure 2:
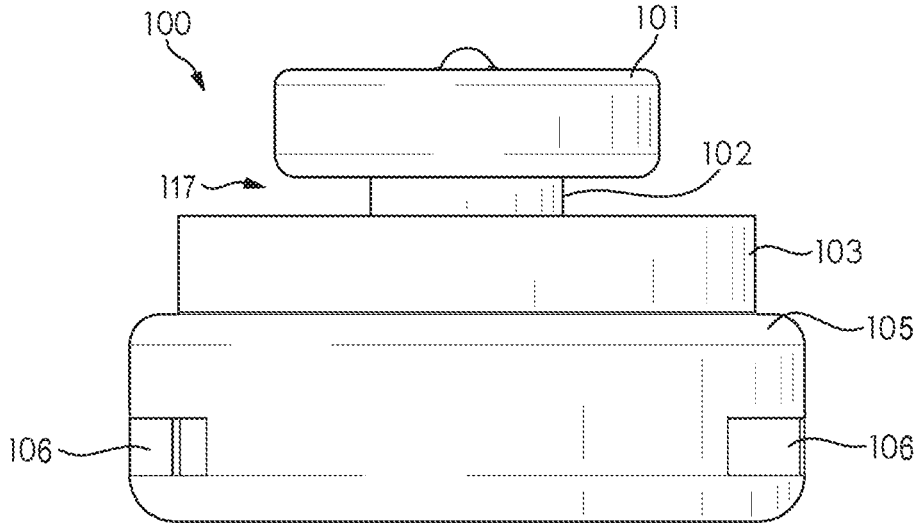
FIG. 2 shows a side view of a button adapter with the connector post on the snap button magnetic component, in accordance with an embodiment of the present invention.
Figure 3:
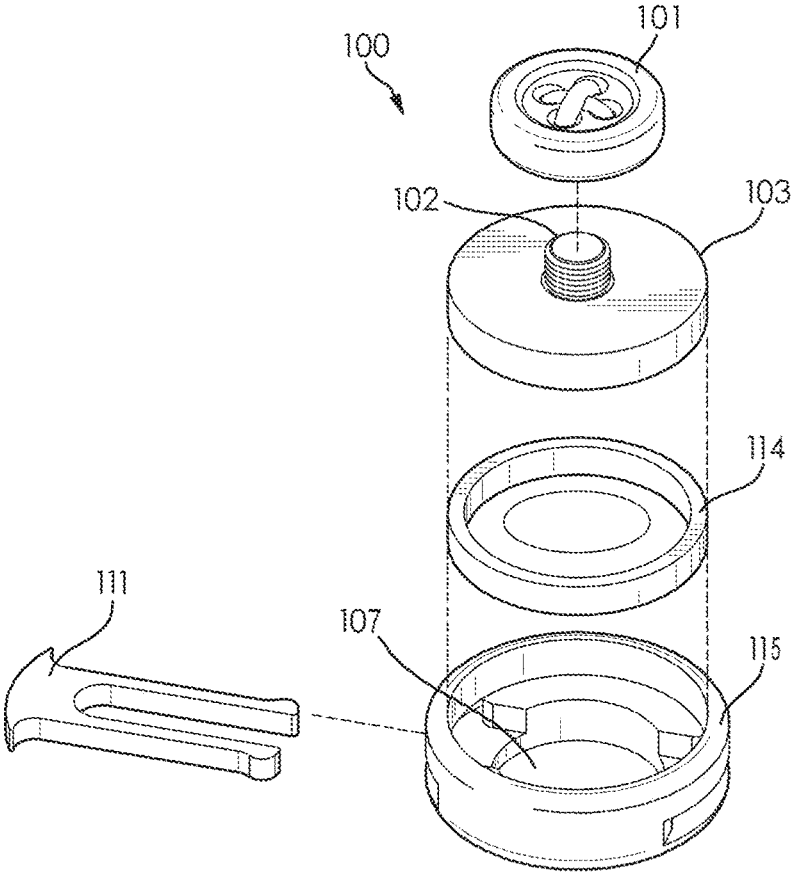
FIG. 3 shows a top exploded view of a button adapter with the connector post on the snap button magnetic component, in accordance with an embodiment of the present invention.
Figure 4:
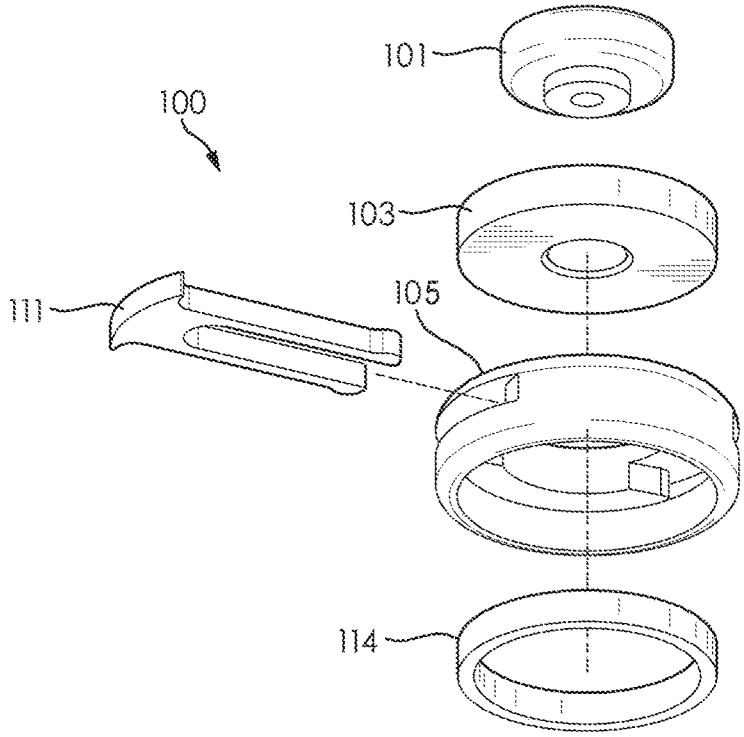
FIG. 4 shows a bottom exploded view of a button adapter with the connector post on the snap button magnetic component, in accordance with an embodiment of the present invention.

Accordingly, it is an object of the present invention to provide a button adapter fastening system which is durable, secure, aesthetically appealing, and immune to jamming, while still being easy to use for people of varying abilities.

According to an embodiment of the present invention, a button adapter fastening system, the fastening system comprising: a snap button with a front face and a rear face, a snap button magnetic component, wherein the snap button and the snap button magnetic component are connected by a connector post to form a buttonhole assembly, a button cover formed with a sidewall and a top face that define a cavity configured to fit over a garment button, a button clip that is configured to slide under the garment button and reversibly engage with the button cover, and a button cover magnetic component that is retained within the button cover, wherein the button cover, the button clip, and the button cover magnetic component collectively form a button cover assembly that reversibly engages with the buttonhole assembly, wherein at least one of the snap button magnetic component and button cover magnetic component is a magnet.

According to an embodiment of the present invention, the connector post is integrally formed on the rear face of the snap button and is configured with a mushroom-shaped tip that engages with the snap button magnetic component.

According to an embodiment of the present invention, the front face of the snap button is formed with a decorative design.

According to an embodiment of the present invention, the snap button magnetic component is a magnetic ring.

According to an embodiment of the present invention, the button clip is formed with a pair of prongs that extend from a clip base and define a slot that is configured to receive a shank of the garment button.

According to an embodiment of the present invention, the sidewall of the button cover is formed with a clip engagement point that is a pair of diametrically opposed holes that are adapted to receive the button clip.

According to an embodiment of the present invention, the each of the prongs and each end of the clip base are formed with a button cover engagement knob that is configured to reversibly engage with the clip engagement point.

According to an embodiment of the present invention, the button magnetic component is positioned above the clip engagement point within the cavity of the button cover.

According to an embodiment of the present invention, the button magnetic component is retained by a ridge formed on an inner portion of the sidewall of the button cover.

According to an embodiment of the present invention, the button magnetic component abuts the top face of the button cover.

According to an embodiment of the present invention, the button magnetic component is positioned below the clip engagement point within the cavity of the button cover and retained by ridges formed on flexible segments of the sidewall.

According to an embodiment of the present invention, the sidewall of the button cover is segmented into flexible segments and rigid segments.

According to an embodiment of the present invention, the diametrically opposed holes are formed in the rigid segments.

According to an embodiment of the present invention, the button clip is a disk formed with a U-shaped notch that is configured to receive a shank of the garment button.

According to an embodiment of the present invention, the sidewall of the button cover is segmented into a plurality of flexible segments, a plurality of which have a tip formed with a ridge, that are configured to grasp the button clip.

According to an embodiment of the present invention, the button cover is attached to the button clip by a hinge and the button clip has an edge formed with a clasp that is configured to reversibly engage with a clip engagement point formed in the sidewall of the button cover.

According to an embodiment of the present invention, the button magnetic component is retained within the cavity of the button cover by a ridge formed on an inner portion of the sidewall of the button cover.

According to an embodiment of the present invention, the top face of the button cover has a beveled edge that guides the buttonhole assembly to seat on the button cover assembly.

According to an embodiment of the present invention, the top face of the button cover is a continuous wall.

According to an embodiment of the present invention, at least one of the snap button magnetic component and the button cover magnetic component is treated with a corrosion resistant coating.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

The present invention generally relates to fastening systems. Specifically, this invention relates to a various embodiments of a fastening system that either attaches to existing buttons and buttonholes of an article of clothing or affixes directly onto the fabric or material of an article of clothing. In preferred embodiments of the present invention, the fastening system has a first portion that attaches to a buttonhole or a first part of the article and a second portion that attaches to a button or second part of the article. The first portion and second portion detachably attach to each other by means of a twist-lock, magnetic mechanism, or some other attachment mechanism. Alternatively, the fastening system can be built directly into an article without augmenting an existing button and buttonhole fastener.

According to an embodiment of the present invention, the button adapter fastening system comprises five primary components divided between two subassemblies. In a preferred embodiment, two of the components, a snap button and a snap button magnetic component, combine as a buttonhole assembly and the other three components, a button cover, a button clip, and a button cover magnetic component, combine as a button cover assembly. In the preferred embodiment, the buttonhole assembly attaches to the buttonhole of a garment, while the button cover assembly attaches to the button of a garment. The buttonhole assembly is configured to reversibly engage with the button cover assembly due to a magnetic attraction between the two assemblies, thereby enabling the fastening system to secure or close a garment in place of the existing button or similar fastener on that garment. When the fastening system is employed on a garment, it allows the wearer of the garment to have a fastener that is more easily manipulated, without altering the appearance or function of the garment itself. In particular, because the fastening system retrofits to the existing fasteners of a garment, there is no need to physically alter the garment to enhance the function of the garment or to make the garment more easily used by the wearer. Alternatively, the fastening system may be incorporated directly into a garment during when the garment is manufacturing, as opposed to being retrofit to an existing garment. Suitable materials for the snap button, button cover, and button clip include but are not limited to polypropylene and polyethylene, while suitable materials for the snap button magnetic component and button cover magnetic component include any suitable magnet or magnetic metal.

According to an embodiment of the present invention, the buttonhole assembly includes a snap button. In a preferred embodiment, the snap button attaches to the snap button magnetic component via a connector post extending from the rear of the snap button that reversibly engages with a corresponding hole or void formed in the snap button magnetic component. The connector post is configured to pass through the buttonhole of garment and attach to the snap button magnetic component such that a space is created between the rear face of the snap button and the front face of the snap button magnetic component. The space formed between the snap button and the snap button magnetic component ensures that there is sufficient space to accommodate the thickness of the garment fabric to which the buttonhole assembly is being attached. Furthermore, because the connector post securely attaches the snap button to the snap button magnetic component, the snap button and the snap button magnetic component act as stops that prevent the buttonhole assembly from sliding out of the buttonhole. In a preferred embodiment, the connector post is preferably a snap connector, featuring a mushroom-shaped tip that is adapted to engage with the hole or void formed in the snap button magnetic component. However, the connector post may be any other suitable connection including, but not limited to, a twist-lock connector or a threaded connector that engages with a corresponding threaded portion of the snap button magnetic component. In some embodiments the snap button and snap button magnetic component may be integrally formed as a single piece of magnetic material or otherwise permanently attached to each other by a connector post to form the buttonhole assembly. In such an embodiment, the snap button portion would be pushed through a buttonhole in a similar fashion as a traditional button, thereby leaving the snap button on one side of the buttonhole, the connector post within the buttonhole, and the snap button magnetic component on the other side of the buttonhole.

According to an embodiment of the present invention, the snap button has the general appearance of a common garment fastener (e.g. button or snap), with a front face that that is designed to replicate the ornamental design or decorative look of a standard garment button or similar fastener, but with a connector post extending from the rear face of the snap button. One of ordinary skill in the art would appreciate that there are many suitable designs for a snap button, and embodiments of the present invention are contemplated to utilize any such design.

According to an embodiment of the present invention, the buttonhole assembly includes snap button magnetic component. In a preferred embodiment, the snap button magnetic component is either a magnet or made from a magnetic material. Useful magnetic materials include, but are not limited to stainless steel, iron, or any other magnetic metal, or a magnetic polymer or rare earth element. The material that makes up the snap button magnetic component and the button cover magnetic component is not significant, but at least one of the magnetic components must be a magnet and the other can be either a magnet or made of any magnetic material or conductive material. For the sake of clarity, as used herein, the term magnetic may refer to a magnet or any magnetic material. As an illustrative example, a magnetic ring may equally be a ring magnet or a metallic washer. Additionally, the snap button magnetic component may be treated with a coating, including any plating, shell, or finish, to resist corrosion and other wear of the magnetic component. In the preferred embodiment, the snap button magnetic component is formed with a hole or void that is adapted to receive the connector post of the snap button. In some embodiments, the hole in the snap button magnetic component has a conical or tapered shape, wherein the diameter of the hole increases in size from one face of the snap button magnetic component to the other.

According to an embodiment of the present invention, the snap button magnetic component is configured to connect to the snap button such that a space is formed to accommodate the thickness of the garment fabric to which the buttonhole assembly is being attached. In a preferred embodiment, the button magnetic component connects to the snap button after the connector post of the snap button passes through the buttonhole of the garment, thereby securely fastening the buttonhole assembly to the buttonhole of the garment such that a portion of the garment is retained between the space formed between the snap button and the snap button magnetic component. In an alternate embodiment of the buttonhole assembly, the connector post may be configured on the front face of the snap button magnetic component, with the snap button being formed with a hole or void that is adapted to engage with the snap or threaded connector post extending from the snap button magnetic component. One of ordinary skill in the art would appreciate that there are many suitable designs for a snap button magnetic component, and embodiments of the present invention are contemplated to utilize any such design.

According to an embodiment of the present invention, the button cover assembly includes a button cover. In a preferred embodiment, the button cover is configured to be placed over a button or similar garment fastener and reversibly secured to that button or similar garment fastener by the button clip. In particular, the button cover is formed with a cavity that is open to the bottom side of the button cover and configured to receive the button or other garment fastener. Furthermore, the button cover is adapted to receive or engage with both the button clip and the button cover magnetic component, with the button clip being configured to pass beneath the button or similar garment fastener when the button clip is engaged with the button cover. In the preferred embodiment, the button cover is substantially circular in shape, but may be any suitable shape to accommodate a particular button or garment fastener. One of ordinary skill in the art would appreciate there are many suitable configurations for a button cover, and embodiments of the present invention are contemplated for use with any such configuration.

According to an embodiment, the cavity of the button cover is defined by a sidewall that forms the perimeter of the button cover. The sidewall may be a continuous wall or segmented into a plurality of sections or teeth. In the preferred embodiment, the inner portion of the sidewall, whether continuous or segmented, may be formed one or more ledges, including, but not limited to lips, flanges, and ridges, that are configured retain the button clip and/or the button cover magnetic component within the button cover cavity. The retaining ledges may be formed continuously around the inner sidewall or may only be formed at certain portions of the inner sidewall, such as only certain of the sidewall segments. Additionally, the button cover sidewall may also be formed with at least one clip engagement point. In the preferred embodiment, the clip engagement point is configured to reversibly engage with a prong or knob formed on the button clip. In some embodiments, the clip engagement point is a pair of diametrically opposed holes that are formed in the button cover sidewall and through which the button clip slides. In some embodiments, the clip engagement point may be one or more ridges or ledges formed on the inner portion of the button cover sidewall and which are configured to grasp the edges of the button clip. In embodiments where the button clip is incorporated onto the button cover with a hinge, the clip engagement point may be a single hole that is formed in the button cover sidewall at position that is opposite of the hinge.

According to an embodiment, the cavity of the button cover is further defined by a top face that is configured to abut with the buttonhole assembly. In a preferred embodiment, the top face of the button cover is formed continuously with the sidewall and may be either solid or formed with a hole. In some embodiments, the top face may have a beveled edge, wherein central portions of the top face are sunken relative to the interface of the top face and sidewall. The beveled edge may be useful for guiding the buttonhole assembly to seat properly on the button cover assembly. In some embodiments, the hole in the top face may have a larger diameter than the snap button magnetic component, thereby permitting direct contact between the snap button magnetic component of the buttonhole assembly and the button cover magnetic component retained within the button cover to advantageously increase the attraction between those components. In other embodiments, the hole in the top face may be smaller than the diameter of the snap button magnetic component, thereby creating some separation between the snap button magnetic component of the buttonhole assembly and the button cover magnetic component retained within the button cover to advantageously reduce the attraction between those components. Additionally, the hole in the top face of the button cover may be useful for accommodating any portion of the connector post that extends beyond the rear face of the snap button magnetic component. Alternatively, the top face of the button cover may be solid, thereby creating some separation between the snap button magnetic component of the buttonhole assembly and the button cover magnetic component retained within the button cover to advantageously reduce the attraction between those components.

According to an embodiment of the present invention, the button cover assembly includes a button clip. In a preferred embodiment, the button clip forms a two-pronged body, with the two prongs extending from a base and defining a gap or slot that enables the button clip to slide under a button or similarly attached garment fastener, including any fastener that is attached to the garment by a shank. The button clip may also be formed with one or more knobs or projections (i.e. button cover engagement knob) that allow the button clip to be reversibly secured to the clip engagement point on the button cover. In some embodiments, the button clip may be configured with knobs on the prongs and/or at the opposite end of the clip body on each side of the clip base. In other embodiments, there may be a single projection (e.g. a clasp or catch) on the edge of the button clip. In some embodiments, the button clip is formed without any button cover engagement knobs and instead is retained with in the button cover by one or more ridges formed on the inner portion of the button cover sidewall. One of ordinary skill in the art would appreciate there are many suitable configurations for a button clip, and embodiments of the present invention are contemplated for use with any such button clip configuration.

Embodiments of the present invention include versions where the button clip is a separate component from the button cover and versions where the button clip and button cover form a single cohesive unit. In a first preferred embodiment, the button clip is a separate component from the button cover. In the first preferred embodiment, the button clip reversibly engages with the button cover either by sliding through the holes forming the clip engagement point or by pressing the button cover over the button clip so that the ridges of the inner portion of the button cover sidewall grasp the button clip, for example, with a friction fit. In a second preferred embodiment, the button clip is attached to the button cover via a flexible hinge. In the second preferred embodiment, the hinge connecting the button clip and button cover is thin piece of flexible plastic that allows the button clip to move between an open and a closed position. When in the closed position, a lip or clasp formed on the edge of button clip engage with the clip engagement point formed in the sidewall of the button cover.

According to an embodiment of the present invention, the button clip is configured to secure the button of a garment within the cavity of the button cover. In a preferred embodiment, the button clip is inserted between the button and the fabric of the garment, such that button shank is received by the slot between the prongs and the prongs are positioned behind the button. When the button clip is inserted into or engaged with the button cover, the prongs of the button clip enable a secure attachment between the button cover and the button or other garment fastener, as the slot between the prongs is sufficiently narrow to prevent the button from falling between the prongs.

According to an embodiment of the present invention, the button cover assembly includes a button cover magnetic component. In a preferred embodiment, the button cover magnetic component is either a magnet or made from a magnetic material. Useful magnetic materials include, but are not limited to stainless steel, iron, or any other magnetic metal, or a magnetic polymer or rare earth element. The material that makes up the button cover magnetic component and the snap button magnetic component is not significant, but at least one of the magnetic components must be a magnet and the other can be either a magnet or made of any magnetic material or conductive material. Accordingly, the attraction level between the buttonhole assembly and the button cover assembly can be regulated by the materials chosen for each of the respective magnetic components, including the strength of any selected magnet and whether one or two magnets are utilized. In addition to the materials selected for the magnetic components, the attraction level between the buttonhole assembly and the button cover assembly can be regulated by where the button cover magnetic component is positioned within the button cover. In some embodiments, the button cover magnetic component is positioned near or against the top face of the button cover, which increase the attractive force between the buttonhole assembly and the button cover assembly. In other embodiments, the button cover magnetic component is retained lower on the sidewall of the button cover, which decreases the attractive force between the buttonhole assembly and the button cover assembly. In a preferred embodiment, the button cover magnetic component is formed with a hole or void (e.g. a washer). In some embodiments, the hole formed in the button cover magnetic component is designed to accommodate the button or other garment fastener to which the button cover is attached. In an alternate preferred embodiment, the button cover magnetic component is formed without any holes or voids.

Advantageously, embodiments of the present invention are convenient for young children, stroke recoverees, people with neurological disorders (e.g. Cerebral Palsy and Parkinson's), people with ALS, persons with advanced Dementia, people with multiple sclerosis, injured veterans, people with arthritis, amputees, or any other person with disability that may make use of standard garment fasteners difficult. Given that embodiments of the present invention provide an adapter that simplifies the opening and closing of the existing garment fastener to which the adapter is attached, without altering the garment or the primary function served by the existing fastener, those persons enumerated above are provided a means for conveniently utilizing articles they may have been prevented from using previously.

Exemplary Embodiments

Referring now to FIGS. 1-4, an embodiment of the button adapter fastening system where the connector post is on the snap button magnetic component. The button adapter 100 primarily comprises a buttonhole assembly and a button cover assembly. The buttonhole assembly comprises a snap button 101 that is screwed to a snap button magnetic component 103 via a threaded connector post 102 in order to attach the buttonhole assembly to the buttonhole of a garment. By attaching the snap button 101 to the snap button magnetic component 103, the connector post 102 creates a space 117 between the rear face of the snap button 101 and the front face of the snap button magnetic component 103 that will accommodate the thickness of the garment to which the buttonhole assembly is being attached. The button cover assembly comprises a button cover 105 that is configured to receive the button clip 111 and the button cover magnetic component 114. The button clip 111 slides into the clip engagement point 106 and under a button to secure the button cover 105 to the button. The button cover magnetic component 114 is retained within the button cover 105 to enable a magnetic attraction with the snap button magnetic component 103 of the buttonhole assembly. The button cover 105 may be formed with a hole 107. As shown by greater detail in FIGS. 5 and 9, the buttonhole assembly is attached to the buttonhole of a garment and the button cover assembly is attached over the button of a garment to provide a magnetic fastener for securing the garment, as opposed to a traditional button.

Figure 5:
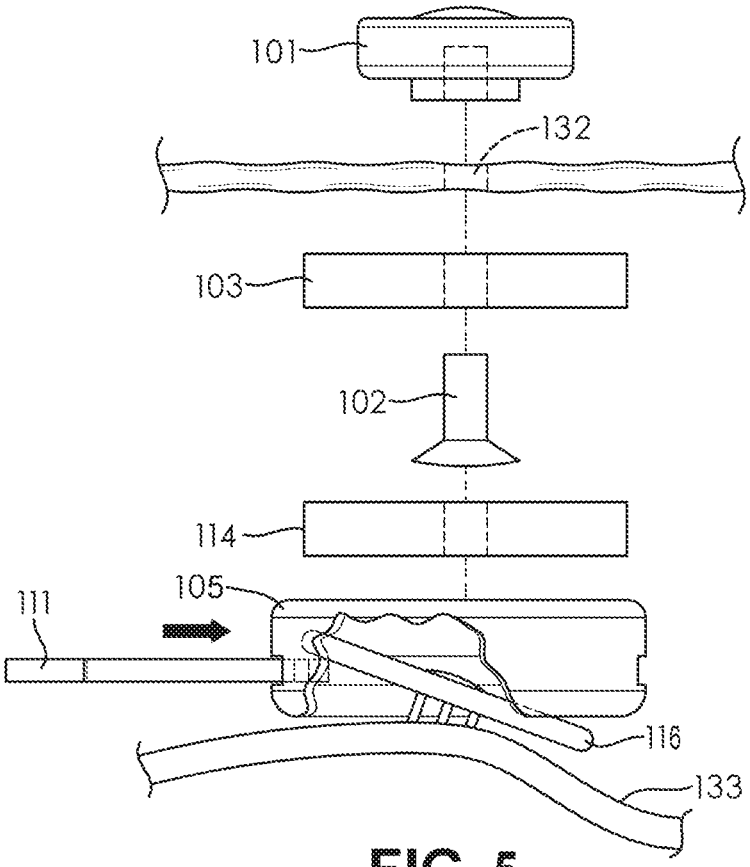
FIG. 5 is an illustration of a buttonhole assembly of a button adapter being connected to a buttonhole of a garment and a button cover assembly of a button adapter being connected to a button of a garment, in accordance with an embodiment of the present invention.

Referring now to FIG. 5, an illustration showing a button adapter being connected to a garment, in accordance with an embodiment of the present invention. A connector post 102 connects between the snap button 101 and the snap button magnetic component 103, through a buttonhole 132 of a garment, thereby securing the buttonhole assembly to the buttonhole 132 of the garment. A button 116 attached to a garment 133 fits inside a button cavity of the button cover 105 and the button clip 111 slides into the button cover 105 at the clip engagement point 106, underneath the button 116, and snaps into the opposite side of the button cover 105, securing the button 116 inside the magnetic button cover 105 and securing the button cover 105 to the garment 133. The button cover magnetic component 114 is retained by the button cover 105, thereby enabling the button cover assembly to have a magnetic attraction with the buttonhole assembly.

Figure 6:
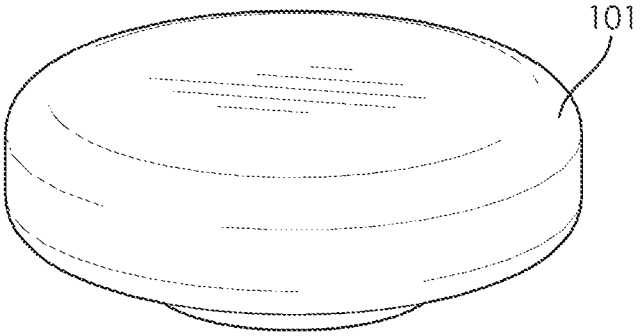
FIG. 6 shows perspective view of a snap button configured to receive a connector post, in accordance with an embodiment of the present invention.
Figure 7:
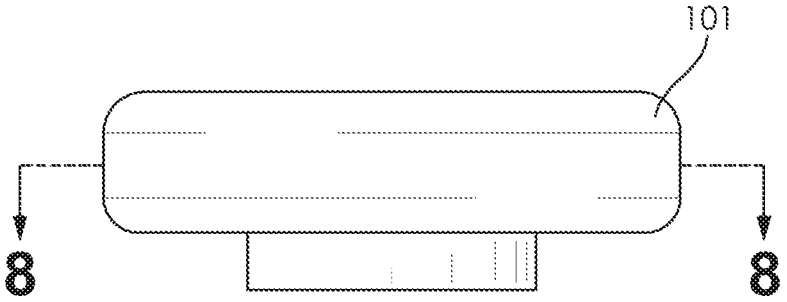
FIG. 7 shows side view of a snap button configured to receive a connector post, in accordance with an embodiment of the present invention.
Figure 8:
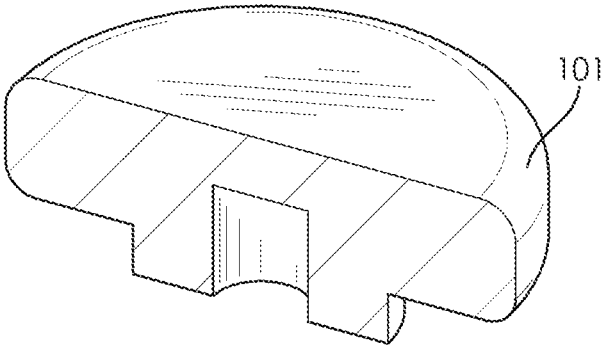
FIG. 8 shows sectional view of a snap button configured to receive a connector post, in accordance with an embodiment of the present invention.

Referring now to FIGS. 6-8, an exemplary embodiment of a snap button configured to receive a connector post, in accordance with an embodiment of the present invention. These exemplary embodiments show a snap button 101 that has a slightly wider diameter than a standard snap button. The extra width makes the snap button 101 ideal for inclusion of graphics or texts, such as graphics licensed from sports teams. Preferred embodiments of such snap buttons could be used on articles of clothing, such as "coaches jacket" style outerwear. Other embodiments of this type of snap button may be used on other articles, as described in detail herein.

Figure 9:
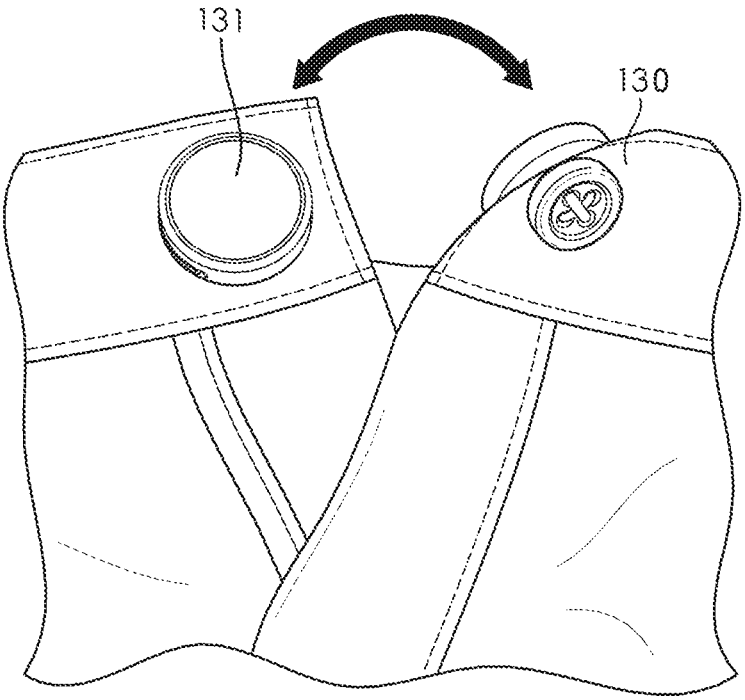
FIG. 9 is an illustration of a button adapter demonstrating how the buttonhole assembly reversibly connects with the button cover assembly, in accordance with an embodiment of the present invention.
Figure 10:
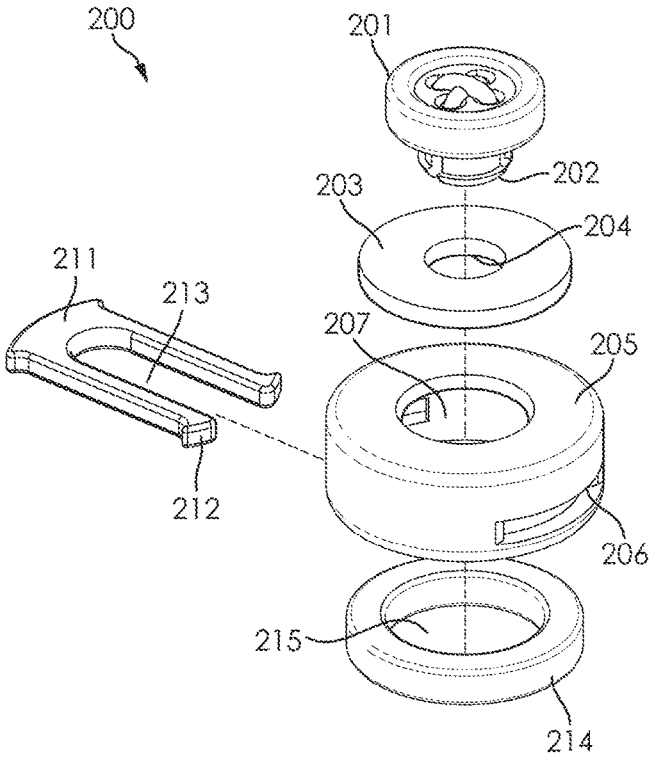
FIG. 10 shows a top exploded view of a button adapter with the connector post formed on the rear face of the snap button, in accordance with an embodiment of the present invention.
Figure 11:
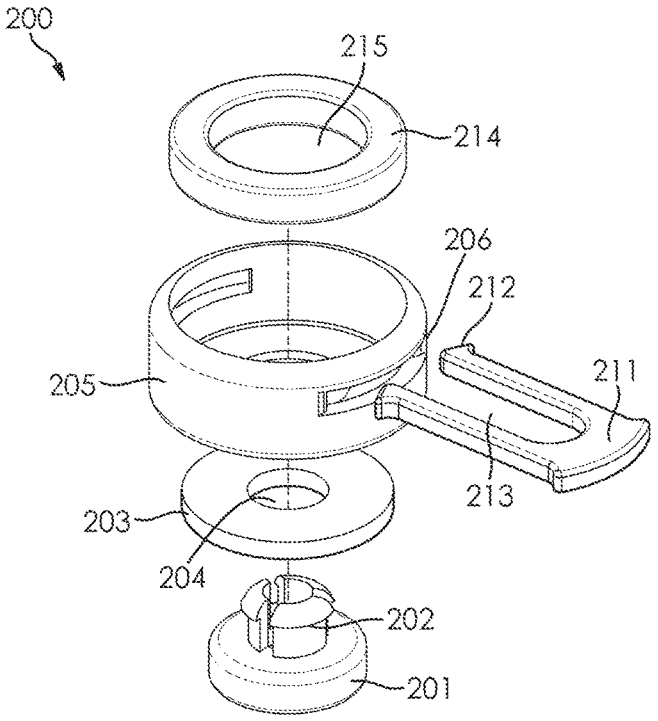
FIG. 11 shows a bottom exploded view of a button adapter with the connector post formed on the rear face of the snap button, in accordance with an embodiment of the present invention.
Figure 12:
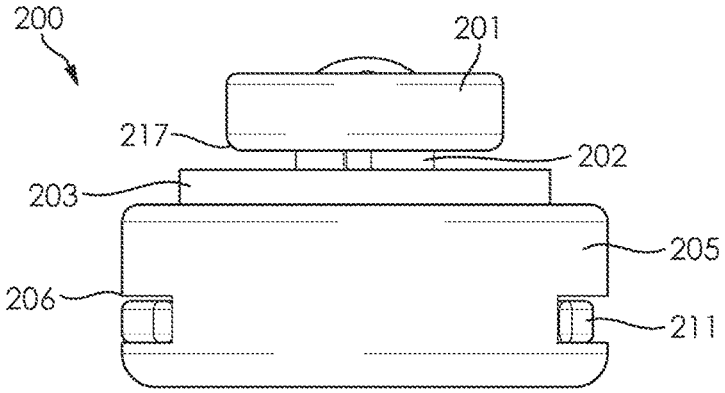
FIG. 12 shows a side view of a button adapter with the connector post formed on the rear face of the snap button, in accordance with an embodiment of the present invention.
Figure 13:
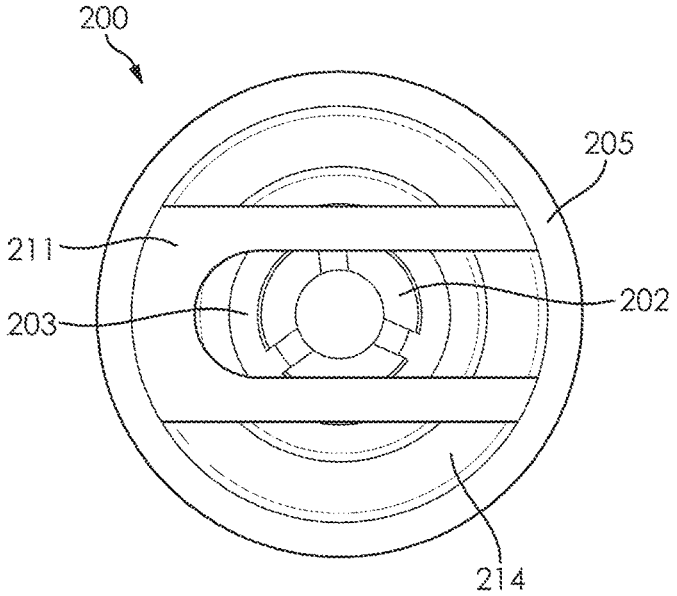
FIG. 13 shows a bottom view of a button adapter with the connector post formed on the rear face of the snap button, in accordance with an embodiment of the present invention.
Figure 14:
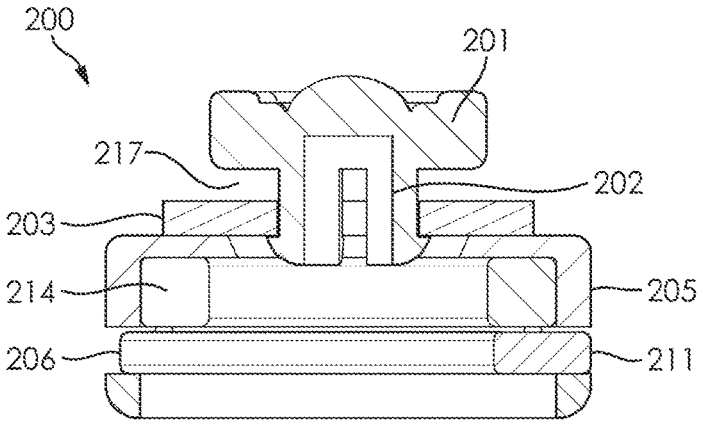
FIG. 14 shows a sectional view of a button adapter with the connector post formed on the rear face of the snap button, in accordance with an embodiment of the present invention.
Figure 15:
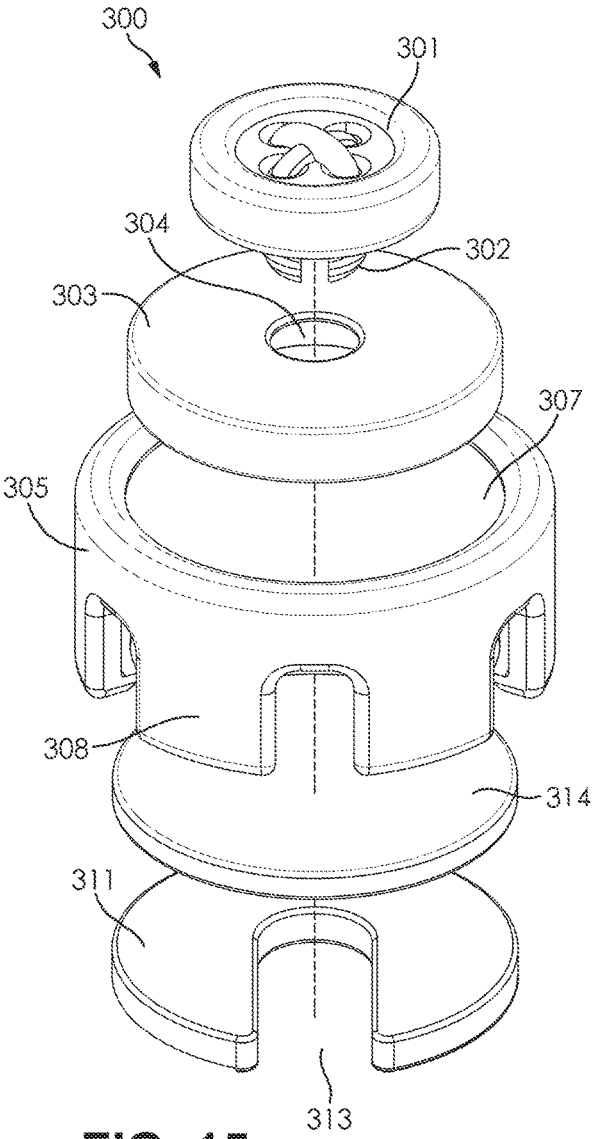
FIG. 15 shows a top exploded view of a button adapter with a button cover configured to snap over the button clip, in accordance with an embodiment of the present invention.
Figure 16:
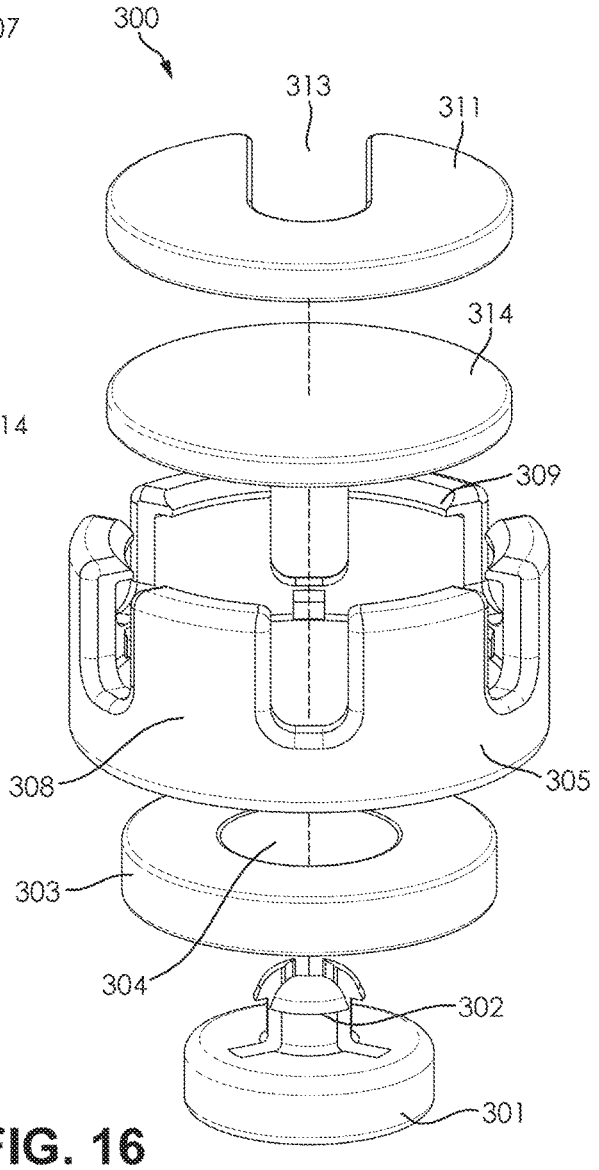
FIG. 16 shows a bottom exploded view of a button adapter with a button cover configured to snap over the button clip, in accordance with an embodiment of the present invention.
Figure 17:
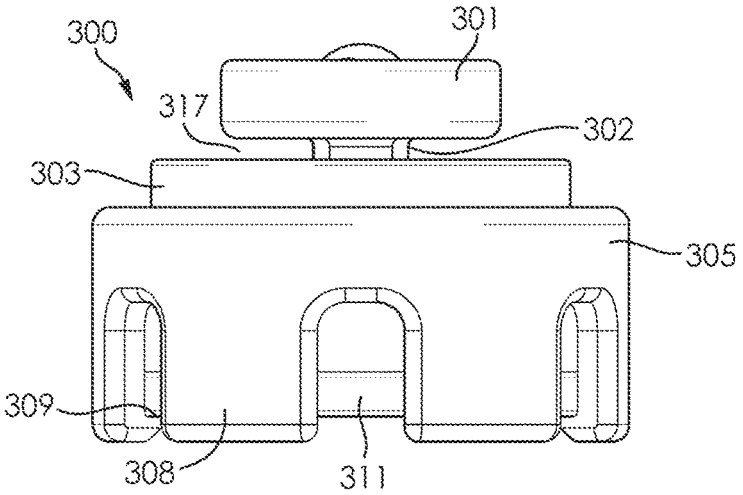
FIG. 17 shows a side view of a button adapter with a button cover configured to snap over the button clip, in accordance with an embodiment of the present invention.
Figure 18:
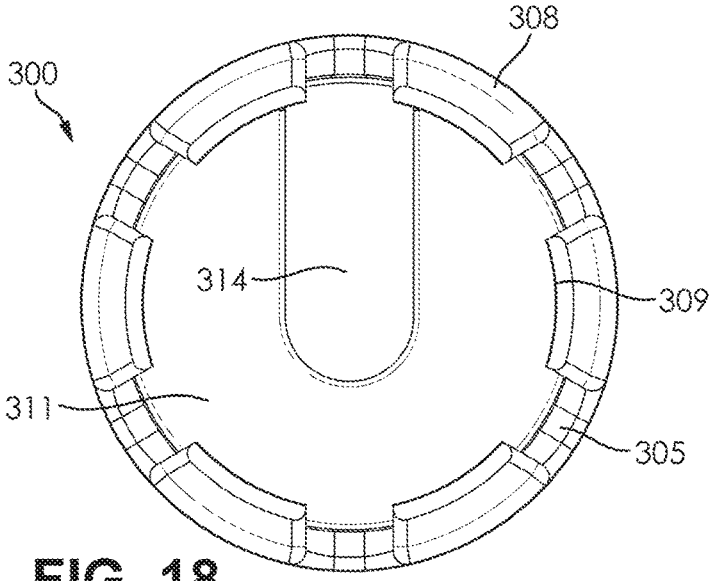
FIG. 18 shows a bottom view of a button adapter with a button cover configured to snap over the button clip, in accordance with an embodiment of the present invention.
Figure 19:
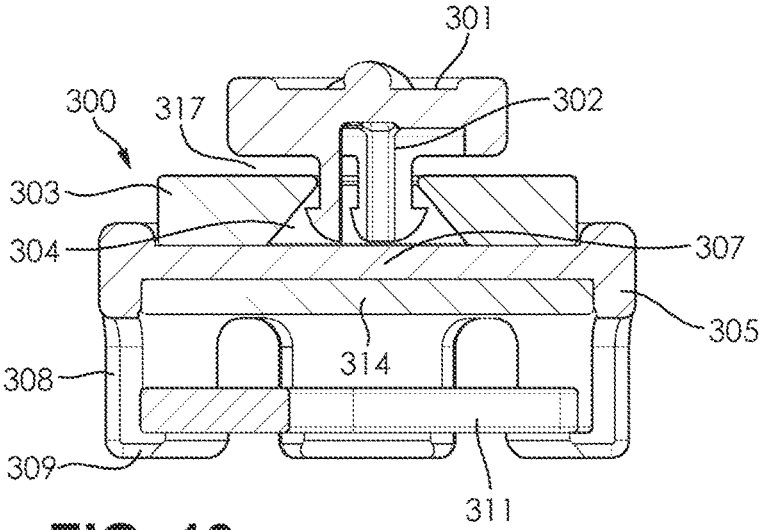
FIG. 19 shows a sectional view of a button adapter with a button cover configured to snap over the button clip, in accordance with an embodiment of the present invention.
Figure 20:
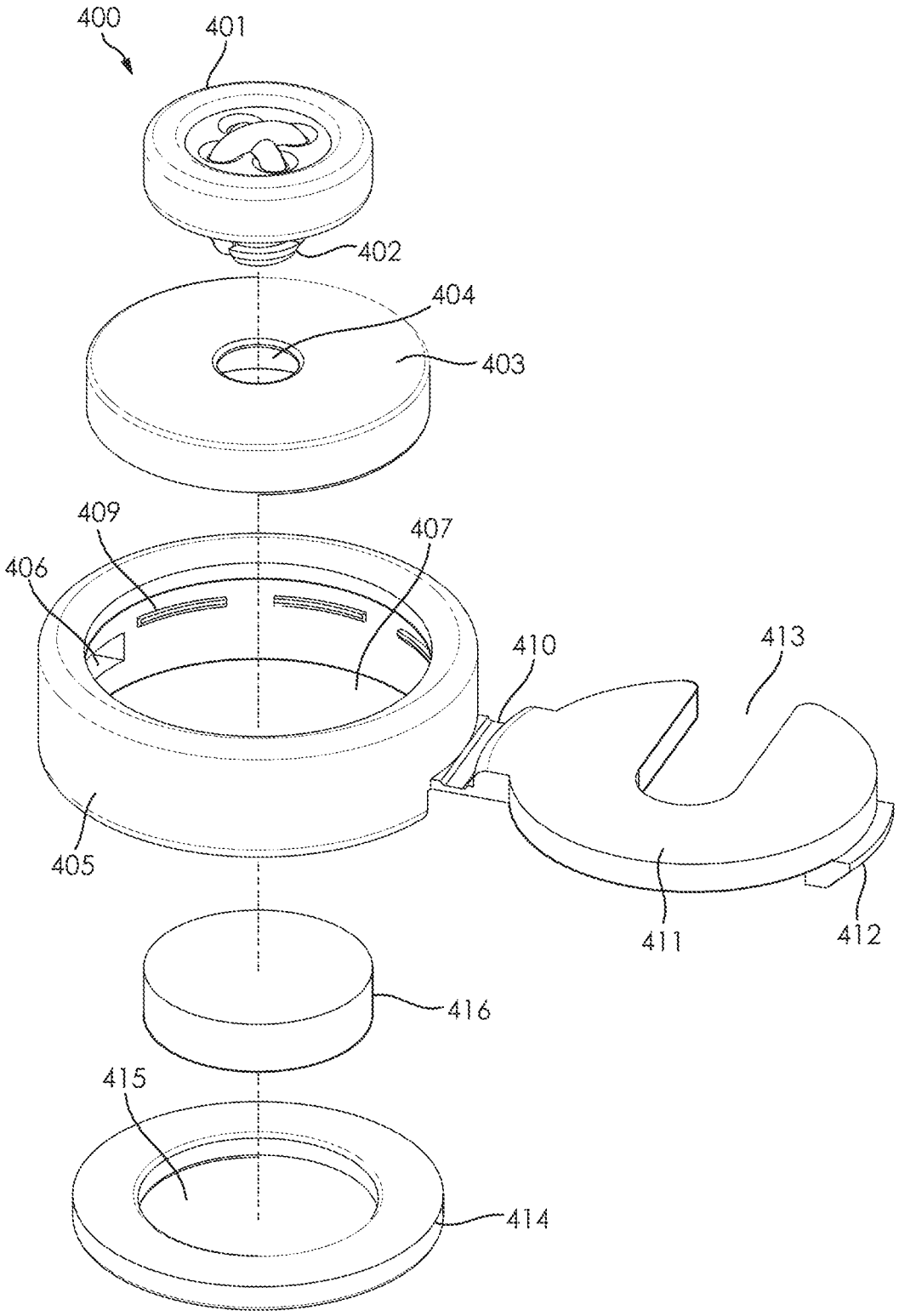
FIG. 20 shows a top exploded view of a button adapter with a button clip hinged on the button cover, in accordance with an embodiment of the present invention.
Figure 21:
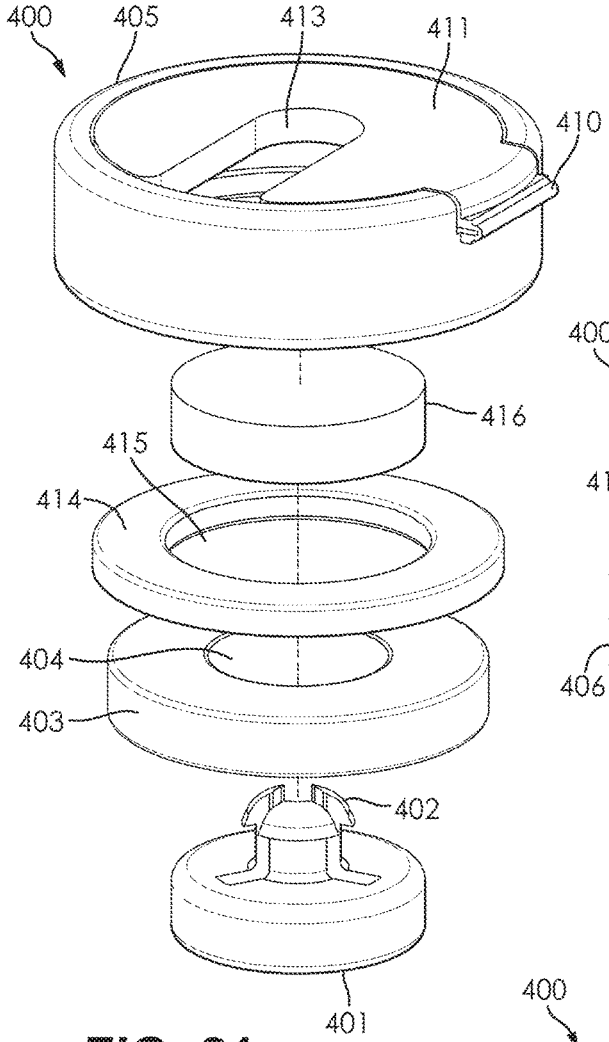
FIG. 21 shows a bottom exploded view of a button adapter with a button clip hinged on the button cover, in accordance with an embodiment of the present invention.
Figure 22:
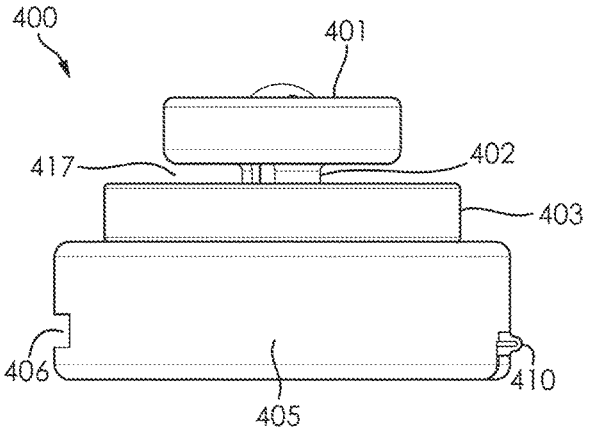
FIG. 22 shows a side view of a button adapter with a button clip hinged on the button cover, in accordance with an embodiment of the present invention.
Figure 23:
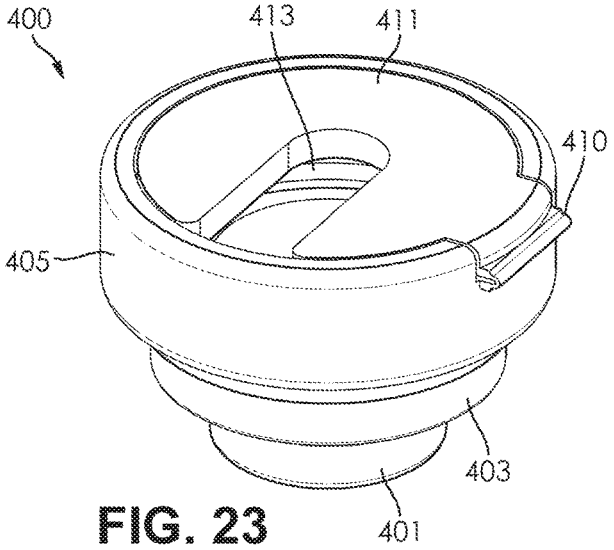
FIG. 23 shows a bottom view of a button adapter with a button clip hinged in the closed position on the button cover, in accordance with an embodiment of the present invention.
Figure 24:
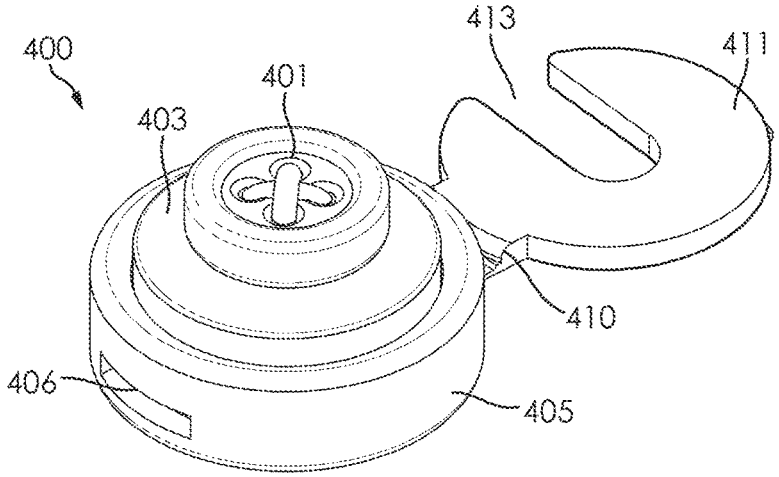
FIG. 24 shows a top view of a button adapter with a button clip hinged in the open position on the button cover, in accordance with an embodiment of the present invention.
Figure 25:
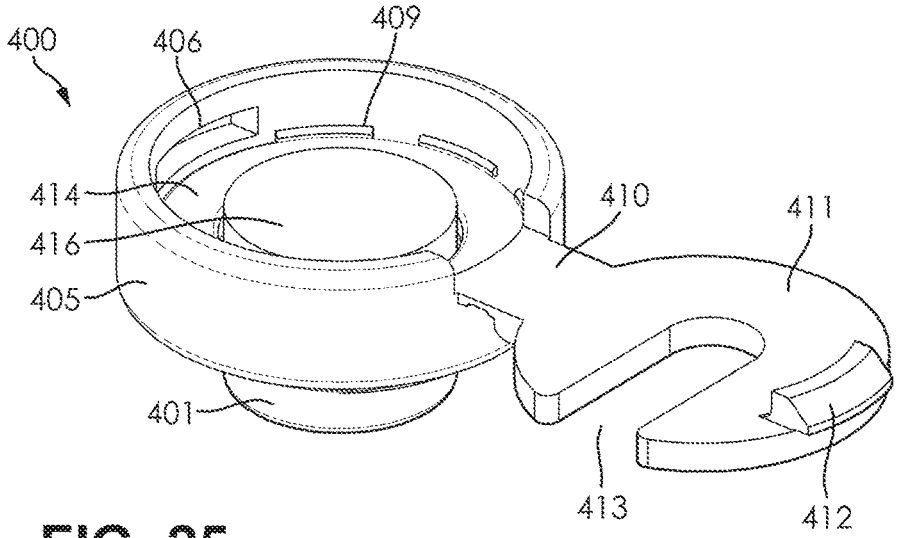
FIG. 25 shows a bottom view of a button adapter with a button clip hinged in the open position on the button cover, in accordance with an embodiment of the present invention.
Figure 26:
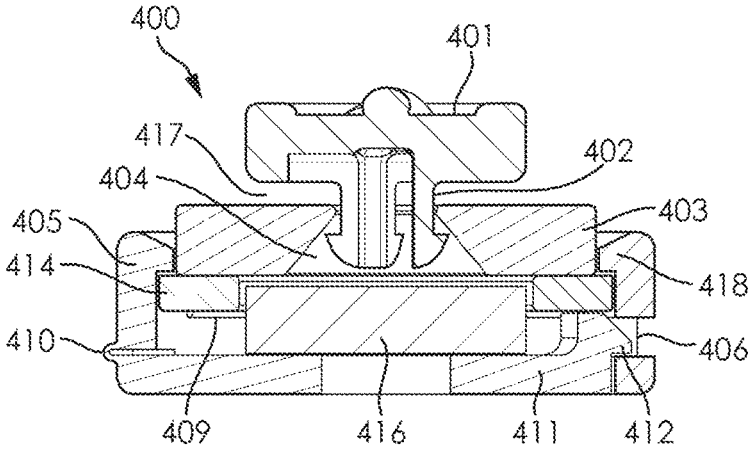
FIG. 26 shows a sectional view of a button adapter with a button clip hinged on the button cover, in accordance with an embodiment of the present invention.
Figure 27:
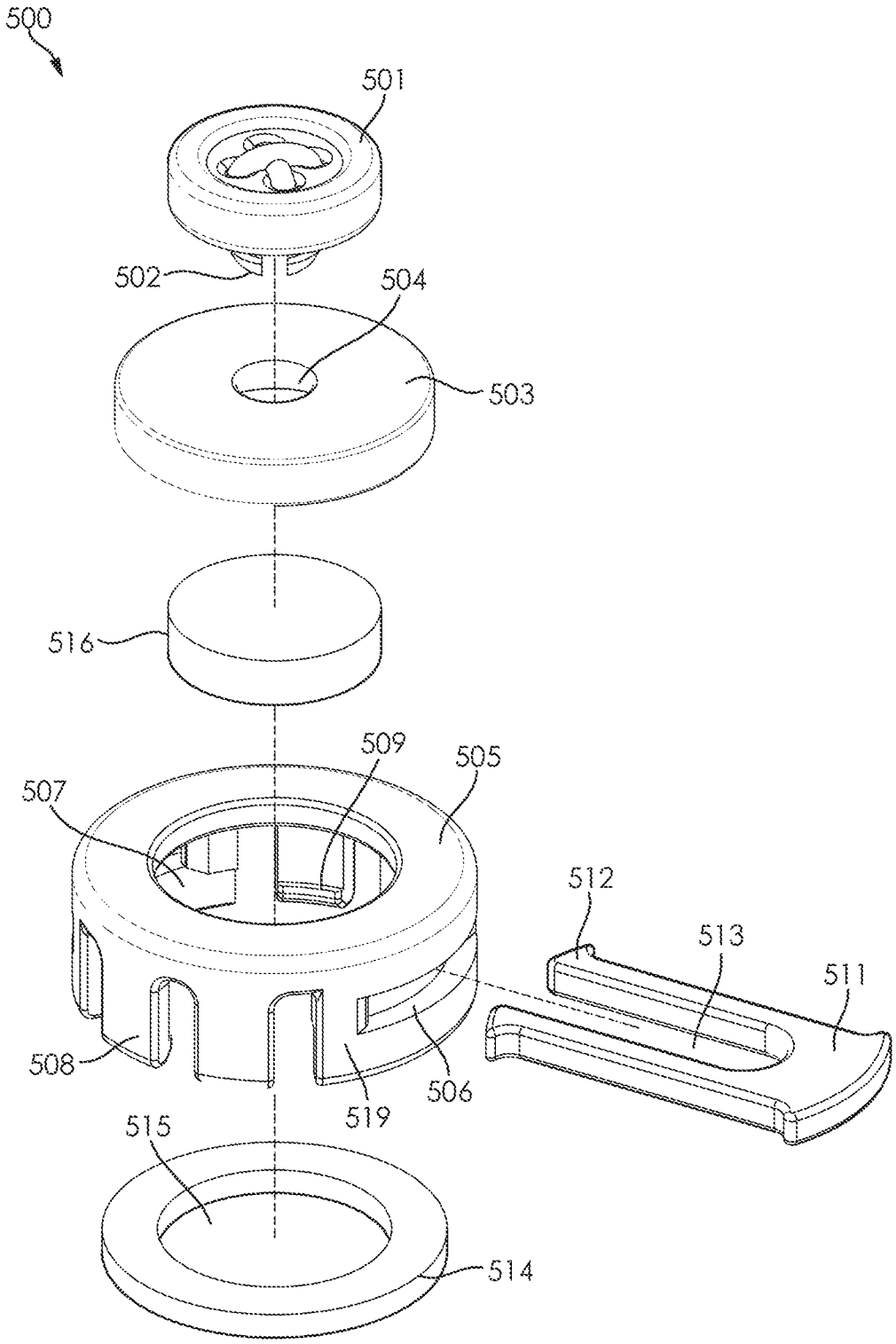
FIG. 27 shows a top exploded view of a button adapter with a segmented sidewall and a button cover magnetic component retained in a lower portion of the button cover in a position that is below the button clip, in accordance with an embodiment of the present invention.
Figure 28:
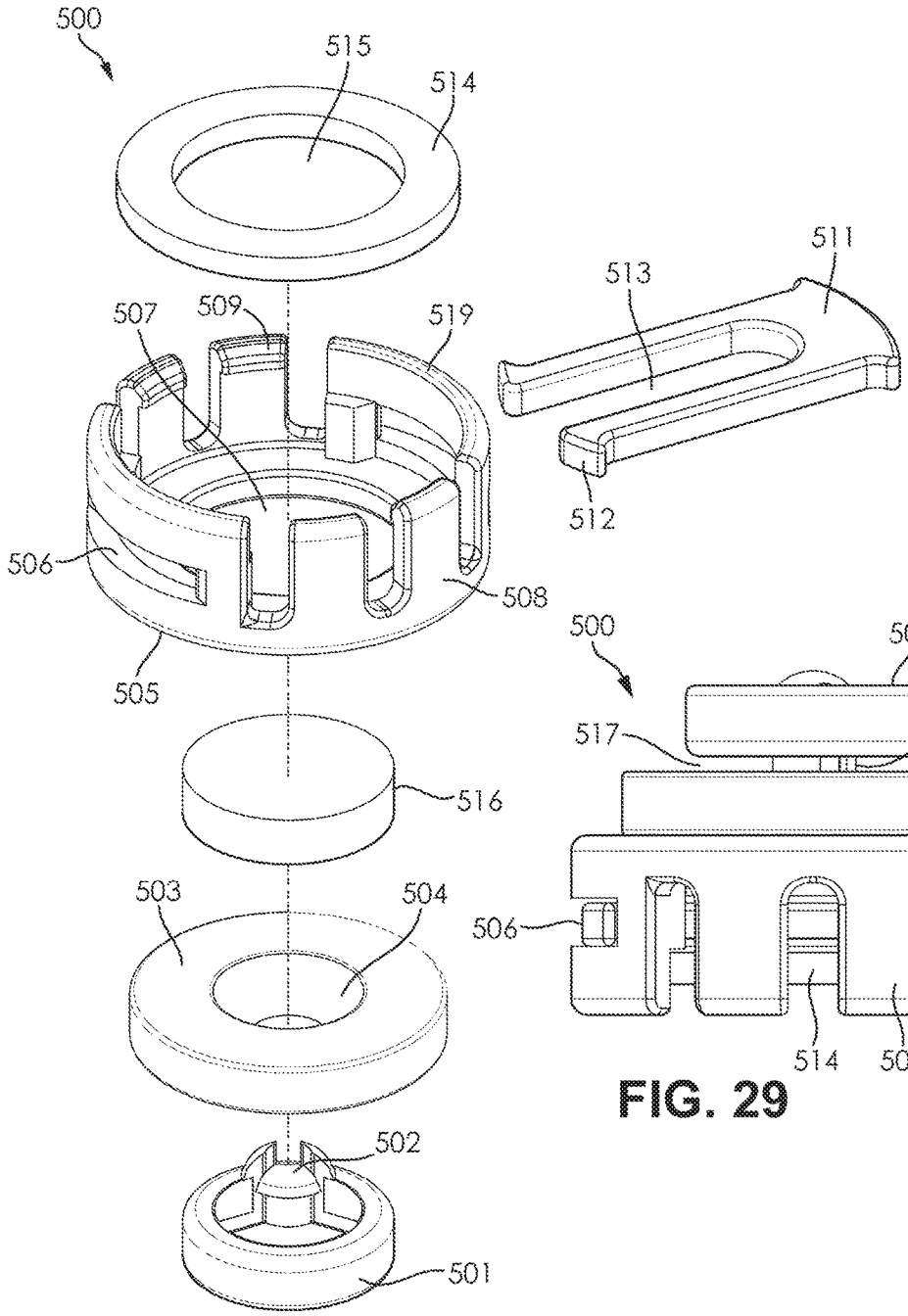
FIG. 28 shows a bottom exploded view of a button adapter with a segmented sidewall and a button cover magnetic component retained in a lower portion of the button cover in a position that is below the button clip, in accordance with an embodiment of the present invention.
Figure 29:
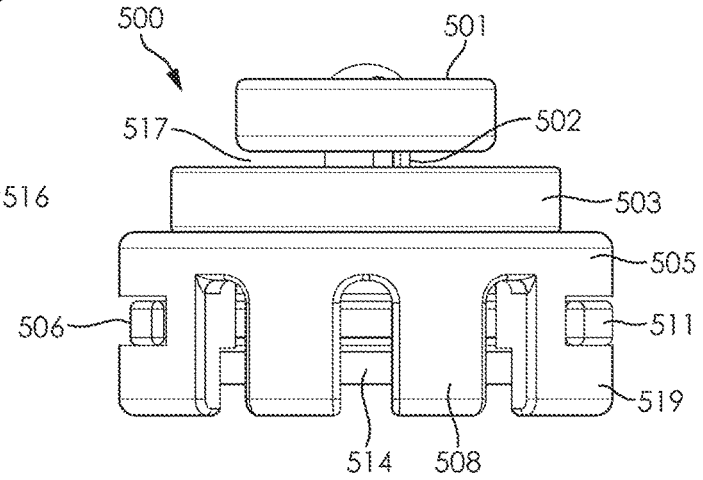
FIG. 29 shows a side view of a button adapter with a segmented sidewall and a button cover magnetic component retained in a lower portion of the button cover in a position that is below the button clip, in accordance with an embodiment of the present invention.
Figure 30:
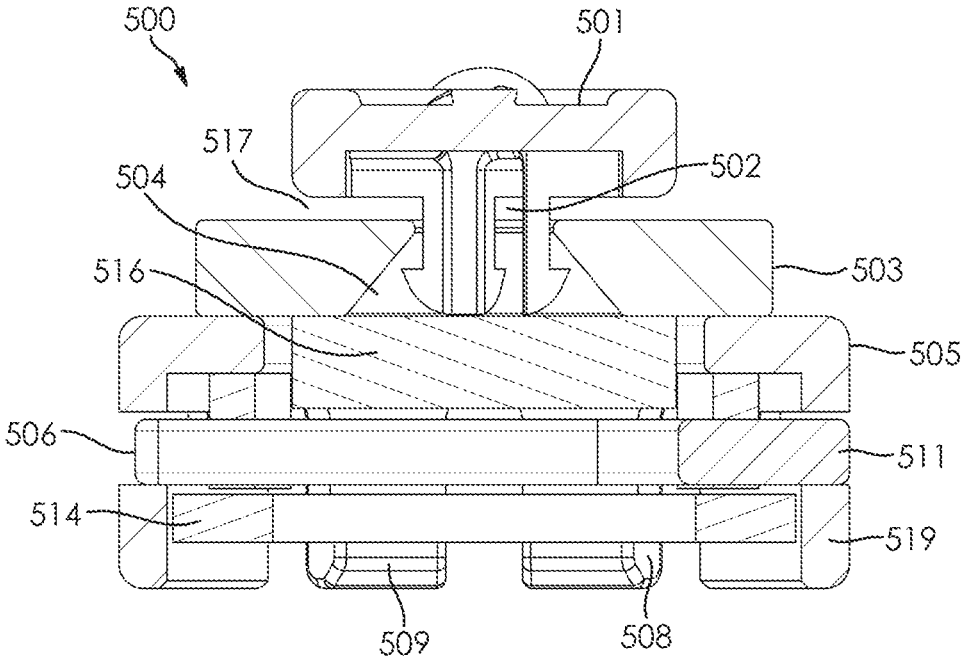
FIG. 30 shows a sectional view of a button adapter with a segmented sidewall and a button cover magnetic component retained in a lower portion of the button cover in a position that is below the button clip, in accordance with an embodiment of the present invention.
Figure 31:
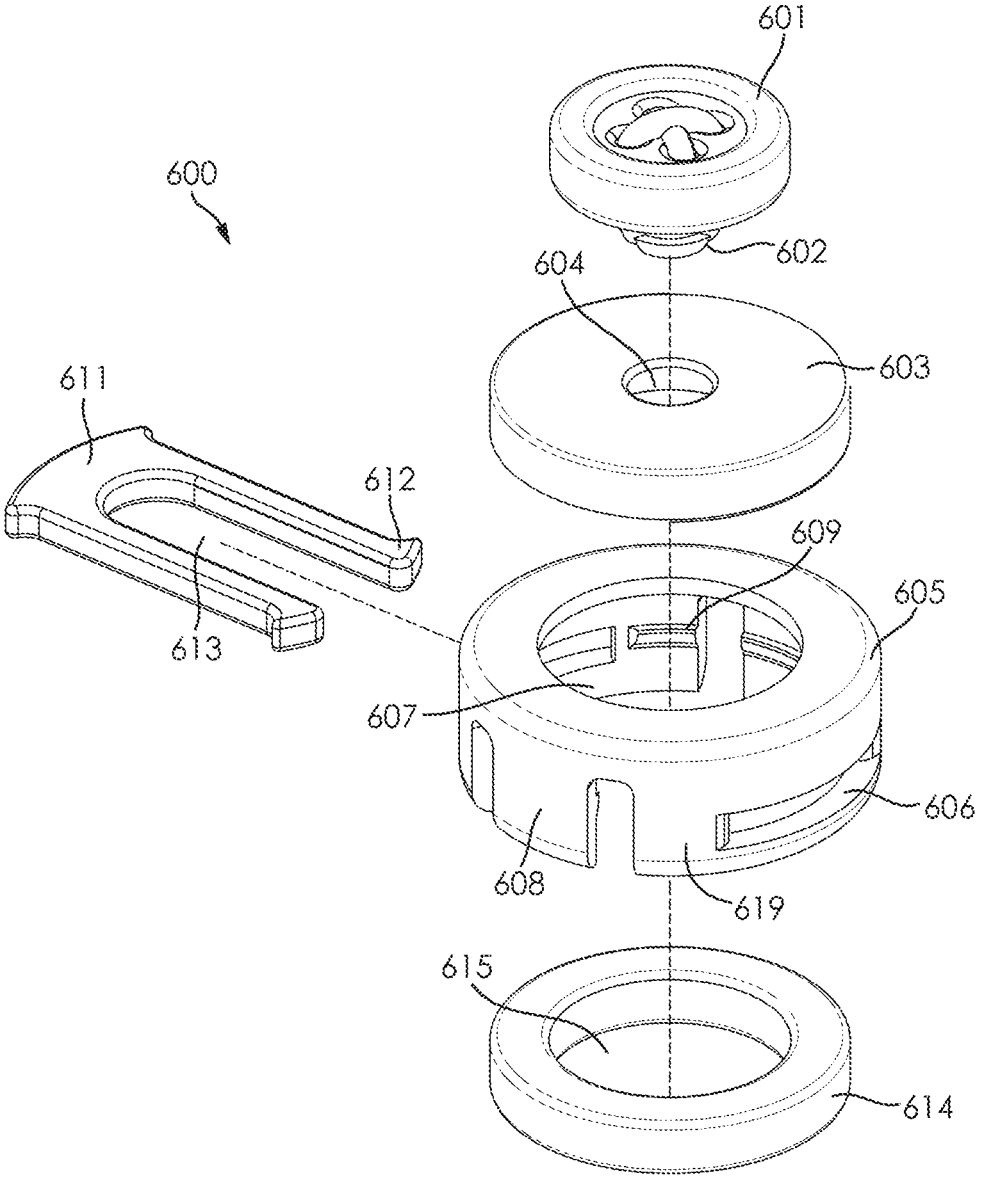
FIG. 31 shows a top exploded view of a button adapter with a segmented sidewall and a button cover magnetic component retained in an upper portion of the button cover in a position that is above the button clip, in accordance with an embodiment of the present invention.
Figure 32:
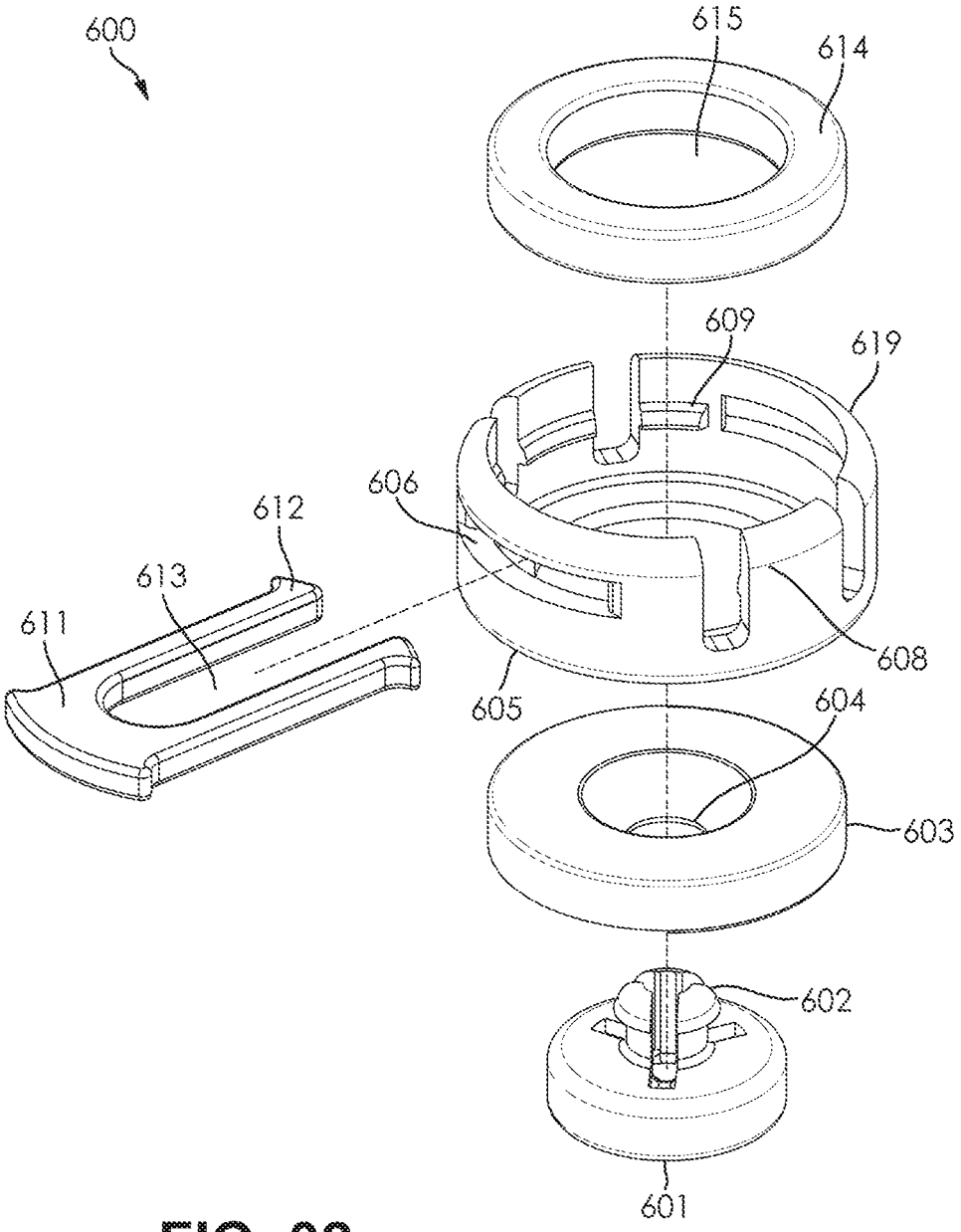
FIG. 32 shows a bottom exploded view of a button adapter with a segmented sidewall and a button cover magnetic component retained in an upper portion of the button cover in a position that is above the button clip, in accordance with an embodiment of the present invention.
Figure 33:
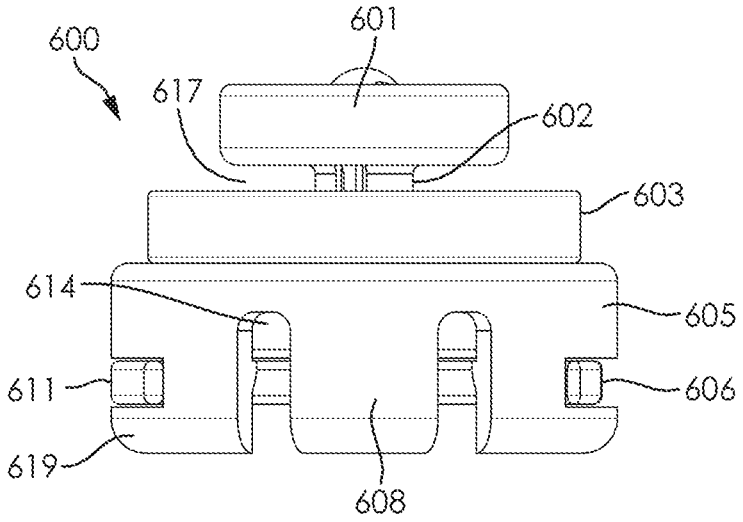
FIG. 33 shows a side view of a button adapter with a segmented sidewall and a button cover magnetic component retained in an upper portion of the button cover in a position that is above the button clip, in accordance with an embodiment of the present invention.
Figure 34:
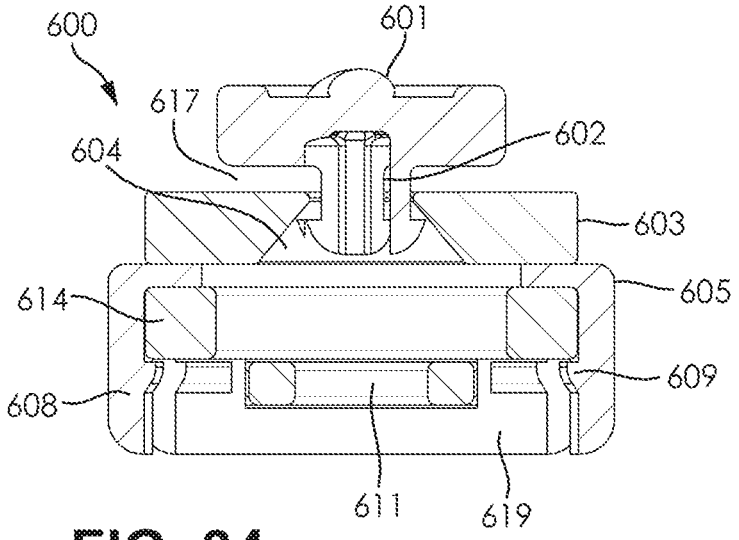
FIG. 34 shows a sectional view of a button adapter with a segmented sidewall and a button cover magnetic component retained in an upper portion of the button cover in a position that is above the button clip, in accordance with an embodiment of the present invention.

Referring now to FIG. 9, an illustration showing the button adapter attached to a garment in accordance with an embodiment of the present invention. The buttonhole assembly 130 is attached to the buttonhole of the garment and the button cover assembly 131 is attached to the button of the garment. The buttonhole assembly 130 and button cover assembly 131 have a magnetic attraction that is enable by the snap button magnetic component of the button cover assembly 130 and the button cover magnetic component of the button cover assembly 131. This magnetic attraction enables a reversible connection between the buttonhole assembly 130 and button cover assembly 131 that both securely fastens the garment and is more easily operated than the existing fastener.

Referring now to FIGS. 10-14, an embodiment of the button adapter fastening system where the connector post is formed on the rear face of the snap button. The button adapter 200 primarily comprises a buttonhole assembly and a button cover assembly. The buttonhole assembly comprises a snap button 201 that is formed with a connector post 202 that has a mushroom-shaped tip that is configured to reversibly fasten to a hole 204 formed in the snap button magnetic component 203. The front face of the snap button 201 is decorative to resemble a traditional button. To attach the buttonhole assembly to a garment, the connector post 202 of the snap button 201 is pushed through a buttonhole of a garment, where the snap button magnetic component 203 is then attached to the snap button 201. By attaching the snap button 201 to the snap button magnetic component 203, the connector post 202 creates a space 217 between the rear face of the snap button 201 and the front face of the snap button magnetic component 203 that will accommodate the thickness of the garment to which the buttonhole assembly is being attached. The button cover assembly comprises a button cover 205 that is configured to receive the button clip 211 and the button cover magnetic component 214. The button clip 211 slides into a first clip engagement point 206, then under a button, and finally clips into place at a second clip engagement point 206 to secure the button cover 205 to the button. The button clip 211 is configured with clip prongs 212 that define a slot 213, such that the pair of clip prongs 212 slides under the rear face of the button, with the slot 213 accommodating the shank that attaches the button to the garment. The button clip 211 may also be formed with one or more button cover engagement knobs, one on the tip of each clip prong 212 and a pair on the opposite end of the button clip 211, that enable the button clip 211 to be reversibly fastened into the clip engagement points 206 of the button cover 205. The button cover magnetic component 214 is retained within the button cover 205 to enable a magnetic attraction with the snap button magnetic component 203 of the buttonhole assembly. The button cover magnetic component 214 is positioned against the top face of the button cover 205 and may be press-fit into the button cover and/or secured with an adhesive. Alternatively, the button cover magnetic component 214 may be held in place by the button clip 211. The button cover magnetic component 214 is formed with a hole 215 to accommodate the button to which the button cover 205 is attached. The button cover 205 may be formed with a hole 207 to accommodate any portion of the connector post 202 of the snap button 201 that may extend beyond the bottom face of the snap button magnetic component 203.

Referring now to FIGS. 15-19, an embodiment of the button adapter fastening system where button cover configured to snap over the button clip. The button adapter 300 primarily comprises a buttonhole assembly and a button cover assembly. The buttonhole assembly comprises a snap button 301 that is formed with a connector post 302 that has a mushroom-shaped tip that is configured to reversibly fasten to a conically shaped hole 304 formed in the snap button magnetic component 303. The front face of the snap button 301 is decorative to resemble a traditional button. To attach the buttonhole assembly to a garment, the connector post 302 of the snap button 301 is pushed through a buttonhole of a garment, where the snap button magnetic component 303 is then attached to the snap button 301. By attaching the snap button 301 to the snap button magnetic component 303, the connector post 302 creates a space 317 between the rear face of the snap button 301 and the front face of the snap button magnetic component 303 that will accommodate the thickness of the garment to which the buttonhole assembly is being attached. The button cover assembly comprises a button cover 305 with a segmented sidewall that is configured to receive the button cover magnetic component 314 and snap over the button clip 311. The button clip 311 slides under a button and then the button cover 305 is snapped down over the button clip 311, as the flexible teeth 308 of the sidewall of the button cover 305 are formed with ridges 309 that grip the button clip 311. The button clip 311 is formed with a notch 313 that enables the button clip 311 to slide under the button and accommodate the shank that attaches the button to the garment. The button cover magnetic component 314 is retained within the button cover 305 to enable a magnetic attraction with the snap button magnetic component 303 of the buttonhole assembly. The button cover magnetic component 314 is positioned against the top face of the button cover 305 and may be press-fit into the button cover and/or secured with an adhesive. Alternatively, the button cover magnetic component 314 may be held in place by a ridge formed on the inner wall of the button cover 305. The button cover magnetic component 314 could also be held in place by a combination of the button clip 311 and button, whereby pressing the button cover 305 over the button clip 311 causes the button clip 311 to press against the button and the button to press against the button cover magnetic component 314. In this embodiment, the button cover magnetic component 214 is not formed with a hole, as the button is retained within the button cover 205 at a position below the button cover magnetic component 314. Additionally, in this embodiment, the button cover 305 may be formed with solid 307 top face featuring a beveled edge that is configured to accommodate the snap button magnetic component 303 and guide the snap button magnetic component 303 into the center of the solid face 307 of the button cover 305. Additionally, the solid top face 307 serves to reduce the attraction between the snap button magnetic component 303 and the button cover magnetic component 314.

Referring now to FIGS. 20-26, an embodiment of the button adapter fastening system where button clip is hinged to the button cover. The button adapter 400 primarily comprises a buttonhole assembly and a button cover assembly. The buttonhole assembly comprises a snap button 401 that is formed with a connector post 402 that has a mushroom-shaped tip that is configured to reversibly fasten to a conically shaped hole 404 formed in the snap button magnetic component 403. The front face of the snap button 401 is decorative to resemble a traditional button. To attach the buttonhole assembly to a garment, the connector post 402 of the snap button 401 is pushed through a buttonhole of a garment, where the snap button magnetic component 403 is then attached to the snap button 401. By attaching the snap button 401 to the snap button magnetic component 403, the connector post 402 creates a space 417 between the rear face of the snap button 401 and the front face of the snap button magnetic component 403 that will accommodate the thickness of the garment to which the buttonhole assembly is being attached. The button cover assembly comprises a button cover 405 that includes a button clip 411 that is attached to the button cover 405 by a hinge 410. The button cover is also configured to receive button cover magnetic component 414. The button clip 411 slides under a button 416 and the button cover is then closed over top of the button clip 411 and the button 416, with the clip engagement point 406 on the button cover 405 reversibly engaging with the clasp (or catch lip) 412 formed on the button clip 411. The button clip 411 is also formed with a slot 413 that enables the button clip 411 to slide under the button 416 and accommodate the shank that attaches the button 416 to the garment. The button cover magnetic component 414 is retained within the button cover 405 to enable a magnetic attraction with the snap button magnetic component 403 of the buttonhole assembly. The button cover magnetic component 414 is positioned against the top face of the button cover 405 and is held in place by a ridge 409 formed on an inner of the sidewall of the button cover 405 and a lip 418 formed from in the beveled edge of the top face of the button cover 405. The button cover magnetic component 414 is formed with a hole 415 to accommodate the button 416 to which the button cover 405 is attached. The button cover 405 may be formed with a hole 407 to accommodate any portion of the connector post 402 of the snap button 401 that may extend beyond the bottom face of the snap button magnetic component 403. Additionally, the hole 407 in the top face of the button cover 405 may have a sufficient diameter to permit the snap button magnetic component 403 to come into direct contact with the button cover magnetic component 414 to increase the attraction between the snap button magnetic component 403 and the button cover magnetic component 414. The edge of the hole 407 may be beveled to guide the snap button magnetic component 403 onto the button cover magnetic component 414.

Referring now to FIGS. 27-30, an embodiment of the button adapter fastening system with a button cover having a segmented sidewall and a button cover magnetic component that is positioned in a lower portion of the button cover below the button clip. The button adapter 500 primarily comprises a buttonhole assembly and a button cover assembly. The buttonhole assembly comprises a snap button 501 that is formed with a connector post 502 that has a mushroom-shaped tip that is configured to reversibly fasten to a conically shaped hole 504 formed in the snap button magnetic component 503. The front face of the snap button 501 is decorative to resemble a traditional button. To attach the buttonhole assembly to a garment, the connector post 502 of the snap button 501 is pushed through a buttonhole of a garment, where the snap button magnetic component 503 is then attached to the snap button 501. By attaching the snap button 501 to the snap button magnetic component 503, the connector post 502 creates a space 517 between the rear face of the snap button 501 and the front face of the snap button magnetic component 503 that will accommodate the thickness of the garment to which the buttonhole assembly is being attached. The button cover assembly comprises a button cover 505 that is segmented into flexible segments 508 and rigid segments 519 and configured to receive the button clip 511 and the button cover magnetic component 514. The button clip 511 slides into a first clip engagement point 506 formed on a rigid segment 519 of the sidewall of the button cover, then under a button 516, and finally clips into place at a second clip engagement point 506 on a second rigid segment 519 to secure the button cover 505 to the button 516. The button clip 511 is configured with clip prongs 512 that define a slot 513, such that the pair of clip prongs 512 slides under the rear face of the button, with the slot 513 accommodating the shank that attaches the button to the garment. The button clip 511 may also be formed with one or more button cover engagement knobs, one on the tip of each clip prong 512 and a pair on the opposite end of the button clip 512, that enable the button clip 512 to be reversibly fastened into the clip engagement points 506 of the button cover 505. The button cover magnetic component 514 is retained within the button cover 505 to enable a magnetic attraction with the snap button magnetic component 503 of the buttonhole assembly. The button cover magnetic component 514 is retained by ridges 509 formed on the tip of each flexible segment 508 of the sidewall of the button cover 505. By positioning the button cover magnetic component 514 below the button clip 511 in the lower portion of the button cover 505, the attractive force between the snap button magnetic component 503 and the button cover magnetic component 514 is reduced. The button cover magnetic component 514 is formed with a hole 515 to accommodate the button to which the button cover 505 is attached. In addition, the top face of the button cover 505 may be formed with a hole 507.

Referring now to FIGS. 31-34, an embodiment of the button adapter fastening system with a button cover having a segmented sidewall and a button cover magnetic component that is positioned above the button clip and abutting the top face of button cover. The button adapter 600 primarily comprises a buttonhole assembly and a button cover assembly. The buttonhole assembly comprises a snap button 601 that is formed with a connector post 602 that has a mushroom-shaped tip that is configured to reversibly fasten to a conically shaped hole 604 formed in the snap button magnetic component 603. The front face of the snap button 601 is decorative to resemble a traditional button. To attach the buttonhole assembly to a garment, the connector post 602 of the snap button 601 is pushed through a buttonhole of a garment, where the snap button magnetic component 603 is then attached to the snap button 601. By attaching the snap button 601 to the snap button magnetic component 603, the connector post 602 creates a space 617 between the rear face of the snap button 601 and the front face of the snap button magnetic component 603 that will accommodate the thickness of the garment to which the buttonhole assembly is being attached. The button cover assembly comprises a button cover 605 that is segmented into flexible segments 608 and rigid segments 619 and configured to receive the button clip 611 and the button cover magnetic component 614. The button clip 611 slides into a first clip engagement point 606 formed on a rigid segment 619 of the sidewall of the button cover, then under a button, and finally clips into place at a second clip engagement point 606 on a second rigid segment 619 to secure the button cover 605 to the button. The button clip 611 is configured with clip prongs 612 that define a slot 613, such that the pair of clip prongs 612 slides under the rear face of the button, with the slot 613 accommodating the shank that attaches the button to the garment. The button clip 611 may also be formed with one or more button cover engagement knobs, one on the tip of each clip prong 612 and a pair on the opposite end of the button clip 612, that enable the button clip 612 to be reversibly fastened into the clip engagement points 606 of the button cover 605. The button cover magnetic component 614 is retained within the button cover 605 to enable a magnetic attraction with the snap button magnetic component 603 of the buttonhole assembly. The button cover magnetic component 614 is retained by ridges 609 formed on the upper portion of the inner sidewall of the button cover 605. In particular, the flexibility of the flexible segments 608 allows the button cover 605 to flex to receive the button cover magnetic component 614. By positioning the button cover magnetic component 614 above the button clip 611 in the upper portion of the button cover 605, the attractive force between the snap button magnetic component 603 and the button cover magnetic component 614 is increased. The button cover magnetic component 614 is formed with a hole 615 to accommodate the button to which the button cover 605 is attached. In addition, the top face of the button cover 605 may be formed with a hole 607.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A button adapter fastening system, said fastening system comprising: a snap button with a front face and a rear face;

a snap button magnetic component, wherein said snap button and said snap button magnetic component are connected by a connector post to form a buttonhole assembly;

a button cover formed with a sidewall and a top face that define a cavity configured to fit over a garment button;

a button clip that is configured to slide under said garment button and reversibly engage with said button cover; and a button cover magnetic component that is retained within said button cover, wherein said button cover, said button clip, and said button cover magnetic component collectively form a button cover assembly that reversibly engages with said buttonhole assembly, wherein at least one of said snap button magnetic component and button cover magnetic component is a magnet;

wherein said snap button magnetic component is a magnetic ring.

2. A button adapter fastening system, said fastening system comprising: a snap button with a front face and a rear face;

a snap button magnetic component, wherein said snap button and said snap button magnetic component are connected by a connector post to form a buttonhole assembly;

a button cover formed with a sidewall and a top face that define a cavity configured to fit over a garment button;

a button clip that is configured to slide under said garment button and reversibly engage with said button cover; and a button cover magnetic component that is retained within said button cover, wherein said button cover, said button clip, and said button cover magnetic component collectively form a button cover assembly that reversibly engages with said buttonhole assembly;

wherein at least one of said snap button magnetic component and button cover magnetic component is a magnet and said button clip is formed with a pair of prongs that extend from a clip base and define a slot that is configured to receive a shank of said garment button;

wherein said sidewall of said button cover is formed with a clip engagement point that is a pair of diametrically opposed holes that are adapted to receive said button clip.

3. The fastening system of claim 2, wherein each of said prongs and each end of said clip base are formed with a button cover engagement knob that is configured to reversibly engage with said clip engagement point.

4. The fastening system of claim 2, wherein said button cover magnetic component is positioned above said clip engagement point within said cavity of said button cover.

5. The fastening system of 4, wherein said button cover magnetic component is retained by a ridge formed on an inner portion of said sidewall of said button cover.

6. The fastening system of 4, wherein said button cover magnetic component abuts said top face of said button cover.

7. The fastening system of claim 2, wherein said button cover magnetic component is positioned below said clip engagement point within said cavity of said button cover and retained by ridges formed on flexible segments of said sidewall.

8. The fastening system of claim 2, wherein said sidewall of said button cover is segmented into flexible segments and rigid segments.

9. The fastening system of claim 8, wherein said diametrically opposed holes are formed in said rigid segments.

10. A button adapter fastening system, said fastening system comprising: a snap button with a front face and a rear face;

a snap button magnetic component, wherein said snap button and said snap button magnetic component are connected by a connector post to form a buttonhole assembly;

a button cover formed with a sidewall and a top face that define a cavity configured to fit over a garment button;

a button clip that is configured to slide under said garment button and reversibly engage with said button cover; and a button cover magnetic component that is retained within said button cover, wherein said button cover, said button clip, and said button cover magnetic component collectively form a button cover assembly that reversibly engages with said buttonhole assembly, wherein at least one of said snap button magnetic component and button cover magnetic component is a magnet;

wherein at least one of said snap button magnetic component and said button cover magnetic component is treated with a corrosion resistant coating.

* * * * *